United States Patent [19]

Fehn

[11] 4,091,761

[45] May 30, 1978

[54] MODIFIED TUNNEL HULL BOAT

[76] Inventor: Allan J. Fehn, 1601 Gardena Ave., Minneapolis, Minn. 55432

[21] Appl. No.: 780,481

[22] Filed: Mar. 23, 1977

[51] Int. Cl.[2] ..... B63B 1/20

[52] U.S. Cl. ..... 114/290; 114/61

[58] Field of Search ..... 114/56, 61, 288, 289, 114/290

[56] References Cited

U.S. PATENT DOCUMENTS

| | | | |
|---|---|---|---|
| 1,010,053 | 11/1911 | Hunter | 114/290 |
| 1,093,475 | 4/1914 | Rosing | 9/1.1 |
| 1,516,750 | 11/1924 | Muskat | 114/61 |
| 2,321,531 | 6/1943 | Thompson | 114/61 X |
| 2,464,957 | 3/1949 | Wood | 114/61 |
| 2,887,978 | 5/1959 | Tritt | 114/271 |
| 2,950,701 | 8/1960 | Stefani | 115/41 |
| 3,101,692 | 8/1963 | Snow | 114/61 |
| 3,126,856 | 3/1964 | Fuller | 114/290 |
| 3,148,652 | 9/1964 | Canazzi | 114/290 |
| 3,191,572 | 6/1965 | Wilson | 114/61 X |
| 3,216,389 | 11/1965 | Thorsen | 114/56 |
| 3,226,739 | 1/1966 | Noe | 114/56 X |
| 3,259,092 | 7/1966 | Kara, Jr. | 114/290 |
| 3,363,598 | 1/1968 | Mortrude | 114/290 |
| 3,450,085 | 6/1969 | van Patten | 114/290 |
| 3,450,090 | 6/1969 | Best, Jr. | 115/39 |
| 3,584,590 | 6/1971 | Rings et al. | 114/61 X |
| 3,930,455 | 1/1976 | Bremer | 114/56 |
| 3,960,102 | 6/1976 | Davy | 114/61 X |

OTHER PUBLICATIONS

Caliber Exclusive Tri-Tunnel Hull Design. Caliber Boats, 1601 Gardena Avenue, Fridley, Minn. 55432, Jun. 1977.

*Primary Examiner*—Trygve M. Blix
*Assistant Examiner*—Sherman D. Basinger
*Attorney, Agent, or Firm*—Kinney, Lange, Westman and Fairbairn

[57] ABSTRACT

A modified tunnel hull boat in which there are two downwardly extending sponsons defining a tunnel between their inner walls, the boat having a center rib projecting downwardly from the bottom of the boat into the tunnel and having a lower wall which acts as a planing surface. The distance between the inner walls of the sponsons and the outer walls of the center rib decreases from the bow to an area adjacent the midpoint of the boat fore and aft and then increases abruptly after this point so as to create a venturi throat. The reduced pressure adjacent the venturi throat tends to minimize the effect of head or tail winds upon the attitude of the boat. The amount of lift on the rearward portion of the boat is also increased so that the bow does not rise as much at high speeds. The introduction of air into the tunnel is increased by the provision of two flat portions adjacent the bow which are directed upwardly in a forward direction so as to act as scoops to direct air into the tunnel to increase the lifting effect. Curved strakes of relatively short length are provided adjacent the bow to give additional lift to the bow at low speeds.

6 Claims, 14 Drawing Figures

MODIFIED TUNNEL HULL BOAT

BACKGROUND OF THE INVENTION

It is quite old to provide a boat hull with a central tunnel and such a boat is commonly called a tunnel hull boat. It is furthermore old to provide a center rib extending down through this hull to give an added planing surface. The difficulty with such prior boats, however, has been that there has been an excessive tendency for the bow to rise at high speeds. A more pleasant effect is obtained when the stern also tends to rise somewhat so that the angle of inclination of the boat at high speeds is not excessive. Furthermore, in many boats of the tunnel hull type, there is a tendency for the boat to be appreciably affected by tail or head winds. Where there is a head wind, the bow tends to rise excessively. Where there is a tail wind, the bow does not rise as much as might be desired. In fact, the stern actually tends to be raised, thereby decreasing the speed of the boat.

SUMMARY OF THE PRESENT INVENTION

The present invention is concerned with a modified tunnel hull boat which has a venturi throat so located as to minimize the tendency of the attitude of the boat to be affected by head or tail winds.

A further feature of the present invention is that the tunnel construction is such with respect to the venturi throat that the lifting force of the air going through the tunnel is distributed between both the bow and stern sections so as to avoid undue raising of the bow at high speeds.

A further feature of the present invention is that the bottom of the boat between the center rib and the sponsons is provided with two flat portions adjacent the bow which are directly upwardly in a forward direction so as to aid in directing air into the channels between the sponsons and the center rib and to increase the lifting effect.

A still further feature is that the outer walls of the center rib are substantially parallel from an area close to the midpoint fore and aft to the stern of the boat.

The desired lifting effect is obtained in part by having the outer walls of the center rib diverge from the bow to an area forwardly of the venturi throat and thereafter being substantially parallel all the way to the stern of the boat.

A still further feature of the present boat is that each sponson has a strake extending from the outer wall of the sponson from the bow end thereof for less than half of the length of the sponson, the forward end of each strake being curved upwardly so that at relatively low speeds the strakes serve to maintain the bow in an elevated position while the boat is obtaining normal operating speed. These strakes do not extend as far aft as the location of the venturi throat so that the lifting effect provided thereby is clearly ahead of the venturi throat.

Various other features of the present invention will be apparent from a consideration of the accompanying specification, claims and drawing.

DESCRIPTION OF THE PREFERRED EMBODIMENT

Figure 1:
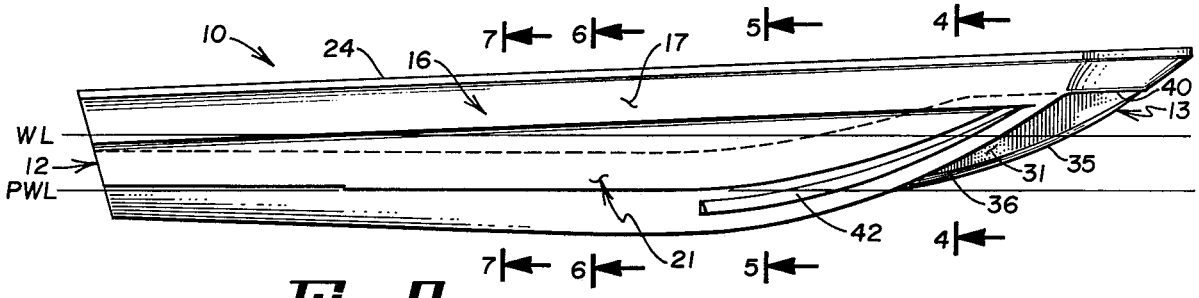
FIG. 1 is a side elevational view of my improved boat.
Figure 9:
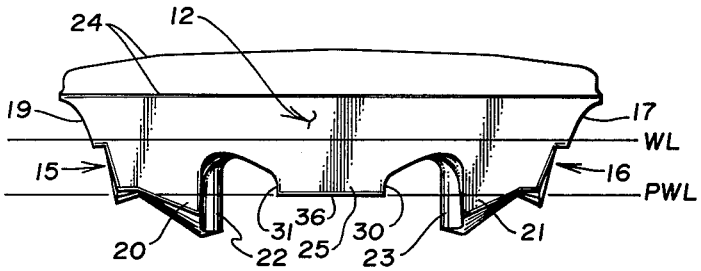
FIG. 9 is a view similar to FIG. 8 but with the bow raised to the position it normally assumes during operation at ordinary speeds.
Figure 2:
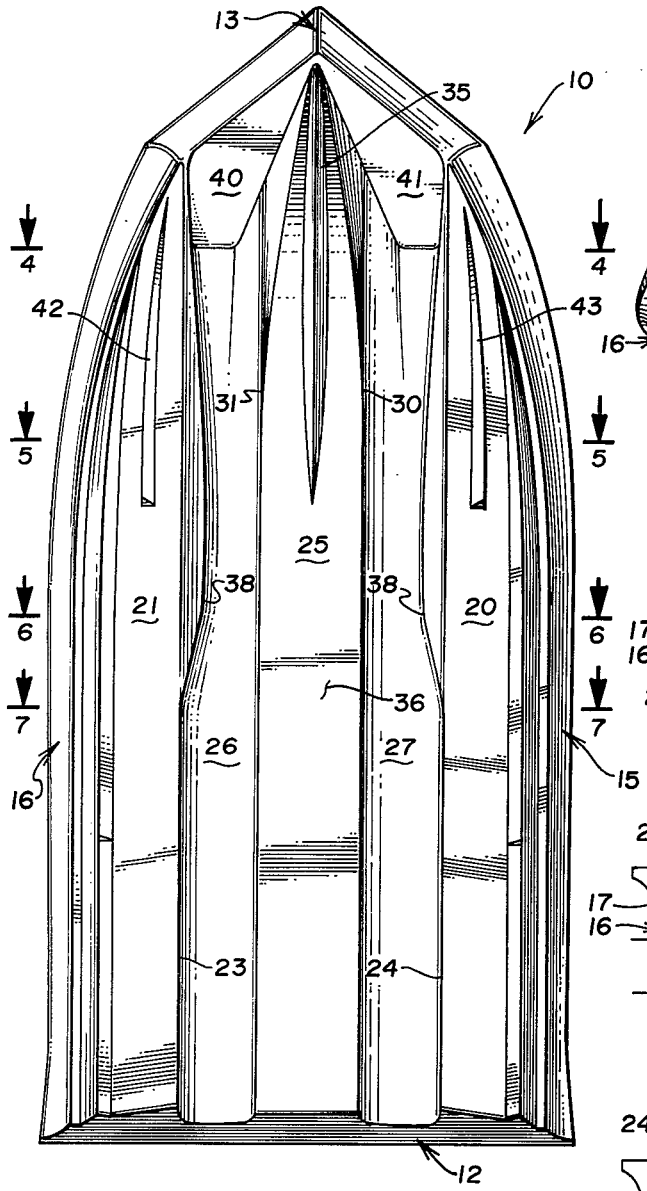
FIG. 2 is a bottom plan view of the boat.
Figure 8:
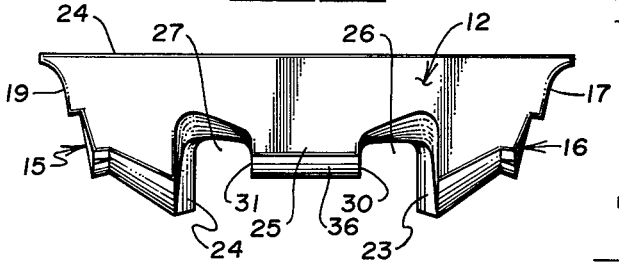
FIG. 8 is a view of the rear or transom of the boat with the sheer plane of the boat horizontal.

Referring particularly to FIGS. 1 and 2, the boat hull is designated in its entirety by the reference numeral 10. It comprises a transom 12, a bow 13 and sides 15 and 16. Referring to the side 16 and particularly to FIG. 1, it will be noted that there is a gunwale 17 best shown in FIGS. 8 and 9 and a sponson 18 which extends downwardly from the gunwale 17. Similarly, on the port side 15 there is a gunwale 19 and a downwardly extending sponson 20, as best shown in FIGS. 8 and 9. Sponsons 20 and 21 have substantially vertical inner walls 22 and 23, respectively, and outer walls that approach the inner walls so that the lower surface of sponsons 20 and 21 is narrow and provides little planing effect. As will be pointed out, these inner walls converge towards each other to produce a pair of venturi throats. Basically, despite their convergence, however, they at all times extend basically vertical with respect to the sheer plane 24 of the boat, defined by the top of gunwales 17 and 19. The spaced walls 22 and 23 form a tunnel and to this extent, the boat is a tunnel hull boat.

Figure 3:
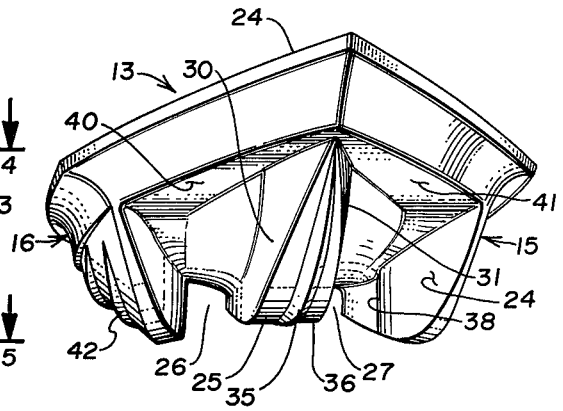
FIG. 3 is a view looking towards the bow of the boat or showing the boat as viewed from the right hand side of FIG. 1.
Figure 4:
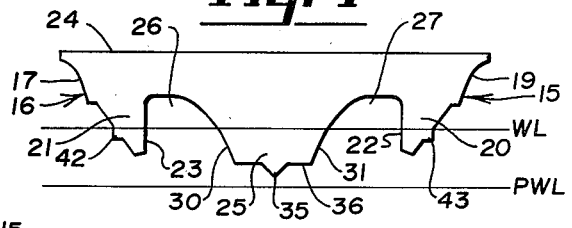
FIG. 4 is a diagrammatic sectional view along the lines 4 — 4 of FIGS. 1 and 2.

Extending downwardly from the bottom of the boat into this tunnel is a center rib 25 which serves to divide the tunnel into two passages 26 and 27, as best shown in the bottom plan view of FIG. 2 and in the sectional views of FIGS. 4 through 7. As best shown in FIGS. 1 and 3, the center rib 25 starts adjacent the bow 13 and is curved downwardly from the bow and extends generally parallel to the bottom of the boat from a point close to the section line 5—5 of FIGS. 1 and 2. As best shown in FIG. 2, the center rib 25 is relatively narrow at the bow and the sides 30 and 31 diverge outwardly to a point close to the section line 5—5. From that area back to the stern, the sides 30 and 31 of the center rib are substantially parallel and the rib is of uniform width from the area adjacent section line 5—5 back to the stern. It will be noted that during the main portion of the center rib 25, these sides are generally vertical and parallel to each other. As they approach the bow, they tend to curve as best shown in FIGS. 3 and 4, to merge with the bottom of the boat. Similarly, as they approach the transom, the sides 30 and 31 are curved, particularly the upper portions thereof. This is probably best shown in FIGS. 7, 8 and 9. A stem 35 which projects downwardly from the center rib 25 serves to increase the directional stability of the boat. The stem 35, as is evident from FIG. 2 and from the sectional views of FIGS. 4 and 5, extends from adjacent the bow to a point just rearwardly of the section line 5—5. To the rear of this stem 35, the bottom 36 of the center rib 25 is basically parallel to the sheer plane 24 to provide a planing surface.

Figure 5:
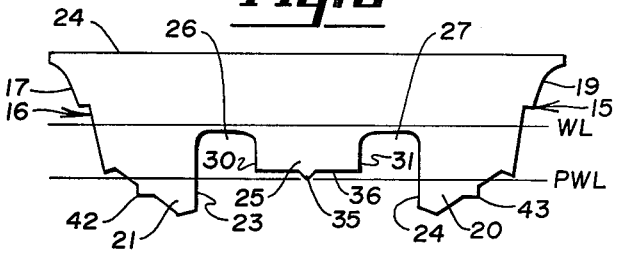
FIG. 5 is a diagrammatic sectional view taken along the lines 5 — 5 of FIGS. 1 and 2.
Figure 6:
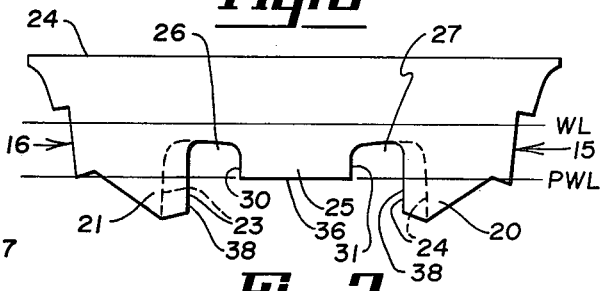
FIG. 6 is a diagrammatic sectional view along the lines 6 — 6 of FIGS. 1 and 2.

In FIGS. 4, 5, 6 and 7, two parallel lines have been drawn, one designated by the legend WL and the other by the legend PWL. The line having the legend WL is supposed to indicate the approximate water line before the boat starts attaining appreciable speed. The line PWL represents the planing water line or the water line after the boat reaches cruising speed. It will be noted that in FIGS. 4 and 5, the stem 35 is clearly within the water and is and is well below the water line WL. At cruising speeds, however, the stem 35, as shown in both FIGS. 4 and 5 is above the planing water line PWL. It will also be noted from FIGS. 6 and 7 that the bottom 36 of the center rib 25 at a point beginning adjacent the section 6—6 and all the way back to the stern is at practically the same height as the planing water line. In other words, the surface 36 at cruising speeds is riding along the surface of the water.

Figure 7:
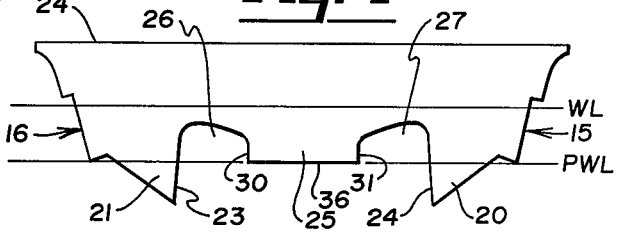
FIG. 7 is a diagrammatic sectional view along the lines 7 — 7 of FIGS. 1 and 2.

As best evident in FIG. 2, the inner surfaces 23 and 24 of the sponsons 20 and 21 curve inwardly to an area adjacent the section 6—6. It will be noted from FIG. 2 that these sides gradually curve towards each other proceeding until a point at which a minimum spacing from the sidewalls 30 and 31 of the center rib 15 is reached, this point being designated by the reference numeral 38. Thereafter, the sidewalls 23 and 24 curve outwardly abruptly and by the time they reach a position corresponding to section plane 7—7, they are substantially parallel to the surfaces 30 and 31. This variation in width is shown in the sectional views of FIGS. 4 through 7. It will be noted that in the sectional view of FIG. 5, the spacing between sidewalls 23 and 30 on one hand and sidewalls 24 and 31 on the other is substantially narrower than the spacing in FIGS. 4 or 7. In the sectional view of FIG. 6 which is taken adjacent the venturi throat 38, the width of the tunnels between sidewalls 23 and 30 and between sidewalls 24 and 31 is at its minimum. In FIG. 7 which represents a sectional view taken along the line 7—7 of FIG. 2, the width of these tunnels has widened appreciably. The width of the tunnels 26 and 27 is substantially uniform from that point back to the stern.

A further very important feature of the present invention is the provision of two flat scoop surfaces 40 and 41 adjacent the bow of the boat. As will be evident from FIGS. 2 and 3, these surfaces are relatively flat and are inclined upwardly. It will be readily apparent that these two surfaces 40 and 41 act as scoops communicating with the two tunnel passages 26 and 27 to increase the flow of air into the tunnel passages.

Two strakes 42 and 43 begin adjacent the bow and extend out laterally from the sponsons. Only strake 42 is visible in FIGS. 1 and 3. It is understood, however, that strake 43, which is shown in FIGS. 2, 4 and 5 is a mirror image of strake 42. These strakes curve upwardly towards the bow, as best shown in FIG. 1. The purpose of strakes 42 and 43 is to assist in lifting the bow at low speeds. It will be apparent from FIGS. 4 and 5 that much of the strakes 42 and 43 are above the planing water line so that they play no part as soon as the boat reaches cruising speed.

OPERATION

As evident from FIGS. 4 through 7, showing the water line when the boat is relatively stationary or moving at very low speeds, the strakes 42 and 43 are entirely below the water line initially. Also, the stem 35 of the center rib 25 is likewise beneath the water line. As the boat begins to move at a higher speed, the two strakes 42 and 43, because of their being curved upwardly, exert a lifting effect on the bow tending to raise the bow and thus put the boat in a better attitude for cruising. The stem 35, during this portion of the operation, tends to stabilize the direction of the craft and decrease the tendency for the bow to move laterally. As the speed of the boat increases, more and more air begins to be drawn into the tunnel passages 26 and 27. As previously indicated, this passage of the air is aided by the upwardly inclined flat scoops 40 and 41 which communicate with the tunnel passages 26 and 27. The result is that the boat tends to rise with respect to the water line until it finally reaches a position with respect to the water line indicated in FIGS. 4 through 7 by the line PWL (planing water line). A very important feature of the present invention is the disposition of the venturi throat 38. It will be noted that the sides 23, 24 of the sponsons 21 and 20 converge gradually to the point 38 and then diverge abruptly as previously described. This has two effects. In the first place, it results in a substantial lifting effect, not only on the fore side of the throat 38, but also on the aft side. Hence, there is a lifting force exerted by the air passing through the tunnels, both forwardly of the venturi throat 38 and also rearwardly. Furthermore, as is well known, the pressure at the throat of the venturi is substantially less than the pressure on either the upstream or downstream side of the venturi. This is because the energy has been converted into kinetic energy and the static pressure decreases. The effect of this is to actually exert a downward force on the boat at the throat of the venturi indicated by the reference numeral 38. Since the area 38 is close to the center of the boat fore and aft, this tends to stabilize the attitude of the boat and make it less subject to head and tail winds.

Figure 10:
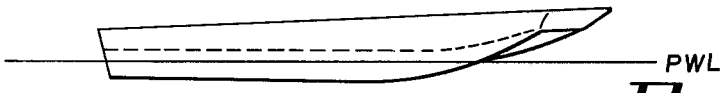
FIG. 10 is a simplified view showing a conventional boat of the tunnel hull type with no wind being present.
Figure 11:
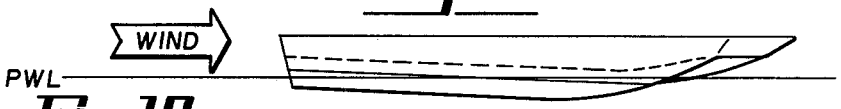
FIG. 11 is a view similar to FIG. 10 but showing the effects of a tailwind on a conventional boat.
Figure 12:
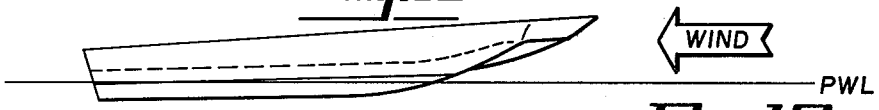
FIG. 12 is a view similar to FIG. 10 but showing the effects of a headwind on a conventional boat.
Figure 13:
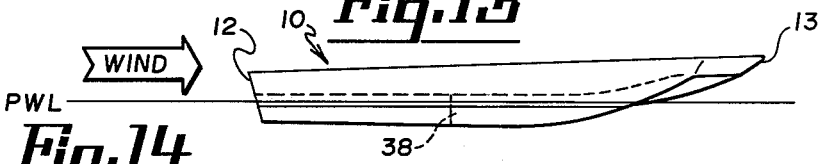
FIG. 13 is a view similar to FIG. 11 but showing the behavior of my improved boat in the presence of a tailwind.
Figure 14:
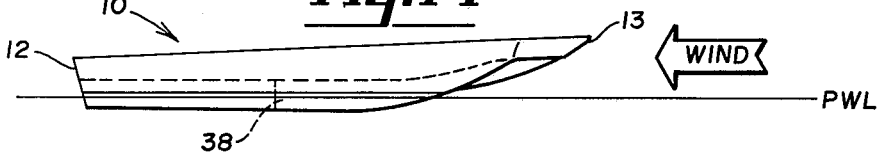
FIG. 14 is a view similar to FIG. 12 but showing the behavior of my improved boat with a headwind.

In FIGS. 10 through 14, this action is illustrated. FIGS. 10 through 12 show the problem that is encountered with an ordinary tunnel hull boat. FIG. 10 illustrates a normal planing position with no appreciable head or tail wind. If, however, there is an appreciable tail wind, the stern tends to rise with respect to the bow as depicted in FIG. 11. This is due to the fact that less air is entering the bow end and the bow tends to sink in the water. On the other hand, with a conventional tunnel boat, if there is a strong headwind, the bow tends to rise excessively as shown in FIG. 12.

Because of the venturi effect and the location of the venturi throat in my boat, the attitude of my improved boat is much less affected by the presence of head or tailwinds. I have shown the venturi throat by a dotted line in FIGS. 13 and 14 and I have designated it by the same reference numeral 38 as used in FIG. 2. It will be noted that this venturi throat is just slightly back of the midpoint of the boat fore and aft. At this point, as previously described, there tends to be a force exerted holding the boat down. Due to this fact and due to the fact that the presence of the venturi throat 38 tends to create an upward lifting pressure on both sides of the throat, the attitude of the boat is affected much less by a head or tail wind. As is evident from FIG. 13, the bow is slightly higher when there is an appreciable headwind than when there is a tailwind. The difference, however, is much less pronounced than is the case with a standard tunnel hull boat.

CONCLUSION

It will be seen that I have provided an improved tunnel hull boat which is designed to cause the bow to be lifted initially at relatively low speeds to a desirable cruising attitude. At the same time, at high speeds, the boat is maintained in a relatively stable position, affected much less than in prior art devices by head or tail winds.

While I have shown a specific structure for purposes of illustration, it is to be understood that the scope of my invention is limited solely by that of the appended claims.

I claim:

1. A modified tunnel hull boat having two sponsons extending downwardly and having facing inner walls which extend generally vertically to define with the bottom a tunnel, said sponsons each having outer walls that approach the inner walls as they extend downwardly so that the lowermost portion of each sponson is very narrow to provide little planing effect, a center rib projecting downwardly from the bottom of the boat into said tunnel and having a relatively wide lower wall which acts as a planing surface, the distance between the inner walls of said sponsons and the outer walls of said center rib decreasing from the bow to an area closely adjacent the midpoint of the boat fore and aft and then increasing abruptly thereafter so as to create a venturi throat adjacent the midpoint of the boat fore and aft so that the reduced pressure adjacent the venturi throat tends to minimize the effect of head or tail winds upon the attitude of the boat.

2. The boat of claim 1 in which the bottom of said boat between said center rib and said sponsons is provided with two flat portions adjacent the bow which are directed upwardly in the fore direction so as to aid in directing air into the channels between said sponsons and said center rib.

3. The boat of claim 1 in which the facing inner walls of the sponsons and the outer walls of said center rib are substantially parallel from an area close to the midpoint fore and aft to the stern of the boat.

4. The boat of claim 1 in which the outer walls of said center rib diverge from the bow to an area forward of said venturi throat and are thereafter substantially parallel all of the way to the stern of the boat.

5. The boat of claim 1 in which each sponson has a strake extending from the outer wall of the sponson from the bow end thereof less than half the length of said sponson, the forward end of each strake being curved upwardly so that at relatively slow speeds, such strakes tend to maintain the bow at an elevated position while the boat is attaining normal operating speeds, the major portions of said strakes being disposed sufficiently high on said boat so as to be above the water line when said boat is operating at planing speeds.

6. The boat of claim 5 in which said strakes do not extend aft as far as the location of said venturi throat.

* * * * *